US012628932B2

(12) United States Patent
Gardet et al.

(10) Patent No.: US 12,628,932 B2
(45) Date of Patent: May 19, 2026

(54) DEVICE FOR PACKAGING AND APPLICATION OF A COSMETIC PRODUCT

(71) Applicant: L'OREAL, Paris (FR)

(72) Inventors: Pierre Gardet, Clichy (FR); Antoine Tirlois, Clichy (FR); Christian Dery, Clichy (FR); William Delbove, Clichy (FR)

(73) Assignee: L'OREAL, Paris (FR)

( * ) Notice: Subject to any disclaimer, the term of this patent is extended or adjusted under 35 U.S.C. 154(b) by 284 days.

(21) Appl. No.: 18/033,233

(22) PCT Filed: Dec. 6, 2021

(86) PCT No.: PCT/EP2021/084326
§ 371 (c)(1),
(2) Date: Apr. 21, 2023

(87) PCT Pub. No.: WO2022/122620
PCT Pub. Date: Jun. 16, 2022

(65) Prior Publication Data

US 2023/0389672 A1 Dec. 7, 2023

(30) Foreign Application Priority Data

Dec. 11, 2020 (FR) ..... 2013040

(51) Int. Cl.
*A45D 33/00* (2006.01)
*A45D 40/22* (2006.01)

(52) U.S. Cl.
CPC ..... *A45D 33/008* (2013.01); *A45D 40/221* (2013.01); *A45D 2200/1018* (2013.01)

(58) Field of Classification Search
CPC .... A45D 33/00; A45D 33/006; A45D 33/008; A45D 33/18; A45D 33/20; A45D 33/22;
(Continued)

(56) References Cited

U.S. PATENT DOCUMENTS 1,632,864 A * 6/1927 Weber ..... A45D 33/28 132/297
D192,960 S * 6/1962 Buderman ..... D3/205
(Continued)

FOREIGN PATENT DOCUMENTS

FR 2814649 A1 4/2002
GB 2177682 A 1/1987
(Continued)

OTHER PUBLICATIONS

KR200469710Y1. Translation (Year: 2013).*
(Continued)

*Primary Examiner* — Rachel R Steitz
*Assistant Examiner* — Karim Asqiriba
(74) *Attorney, Agent, or Firm* — Shumaker, Loop & Kendrick

(57) ABSTRACT

A packaging and application device including a container containing a product to be applied, the container comprising a first part and a second part, which are connected to one another by a hinge connection; an applicator, the said applicator being accommodated in an interior space (E) provided in the hinge connection.

11 Claims, 4 Drawing Sheets

(58) Field of Classification Search
CPC ..... A45D 33/24; A45D 33/26; A45D 33/28; A45D 40/22; A45D 40/24; A45D 40/221; A45D 42/02; A45D 2200/1018
See application file for complete search history.

(56) References Cited

U.S. PATENT DOCUMENTS

| | | | | | |
|---|---|---|---|---|---|
| 3,085,584 | A * | 4/1963 | Hollinger | A45C 11/005 D3/264 |
| 4,524,871 | A * | 6/1985 | Klinger | B65D 5/5023 206/823 |
| 4,555,020 | A * | 11/1985 | Campello | A45D 40/22 206/823 |
| 4,815,608 | A | 3/1989 | Silberberg | |
| 5,301,808 | A * | 4/1994 | Pierson | A45D 40/24 132/297 |
| D353,712 | S * | 12/1994 | Aalders | D3/264 |
| D369,677 | S * | 5/1996 | Bussmann | D3/269 |
| D555,900 | S * | 11/2007 | Pippin | D3/265 |
| 7,380,655 | B1 * | 6/2008 | Thune | A45C 1/06 206/214 |
| 7,770,587 | B2 * | 8/2010 | Bennett | A45D 40/222 132/294 |
| 9,247,803 | B2 * | 2/2016 | Lim | A45D 34/042 |
| 9,867,448 | B2 * | 1/2018 | Apodaca | A45D 40/221 |
| 10,588,393 | B2 * | 3/2020 | Lee | A45D 40/221 |
| 2007/0108093 | A1 * | 5/2007 | Park | A45D 40/221 206/581 |

FOREIGN PATENT DOCUMENTS

| | | | | |
|---|---|---|---|---|
| JP | S59-117413 | U | 8/1984 | |
| JP | H08038246 | A | 2/1996 | |
| KR | 101288852 | B1 | 7/2013 | |
| KR | 200469710 | Y1 * | 11/2013 | A45D 33/025 |
| KR | 101510130 | B1 | 4/2015 | |
| KR | 20160132192 | A | 11/2016 | |
| KR | 20160132193 | A | 11/2016 | |
| KR | 20160145344 | A | 12/2016 | |
| KR | 101908918 | B1 | 10/2018 | |
| WO | 2008/079637 | A1 | 7/2008 | |
| WO | 2012/091268 | A2 | 7/2012 | |
| WO | 2015/020391 | A1 | 2/2015 | |
| WO | 2015/133826 | A1 | 9/2015 | |

OTHER PUBLICATIONS

International Search Report (ISR) for PCT/EP2021/084326 mailed Mar. 3, 2022 (3 pages).
Written Opinion (WO) for PCT/EP2021/084326 mailed Mar. 3, 2022 (5 pages).
Office Action (OA) for corresponding Japanese Patent Application No. 2023-530042; May 13, 2025; 4 pages.
Office Action (OA) for corresponding Chinese Patent Application No. 202180080387.4; Apr. 11, 2025; 7 pages.

* cited by examiner

DEVICE FOR PACKAGING AND APPLICATION OF A COSMETIC PRODUCT

TECHNICAL FIELD

The present invention relates to a device for packaging and application of a cosmetic product, for make-up or care. The invention relates more particularly to a device comprising a container containing the product to be applied and an applicator which is accommodated in the container.

BACKGROUND

Numerous devices of this type are known.

The possibility of snapping an applicator on the exterior of a case by sliding is known for example from U.S. Pat. No. 7,770,587. In U.S. Pat. No. 5,301,808, WO 2015/020391 or FR 2 814 649, one or more applicators can also be placed laterally on the exterior of the case. As far as these cases are concerned, there is a risk of losing the applicator if it becomes separated from the case.

In international application WO 2012/091268, the cosmetic case makes it possible to discharge liquid content for make-up.

In international application WO 20081079637, the case can be folded into three parts.

The patents or patent applications U.S. Pat. Nos. 1,632,864, 4,524,871, WO 2015/133826, KR 20160132192, KR 20160132193, KR 20160145344, KR 101908918, JPH08038246 A relate to compact cases which accommodate a lipstick.

In application GB 2 177 682, an electric battery is accommodated in the hinge of the case.

There is a need to benefit from a compact, convenient device, wherein an applicator can be easily accessible, without risk of losing or damaging the said applicator.

SUMMARY OF THE INVENTION

The subject of the invention is thus a device for packaging and application, comprising:

- a container containing a product to be applied, the container comprising a first part and a second part, which are connected to one another by a hinge connection;
- an applicator, the said applicator being accommodated in an interior space provided in the hinge connection.

The invention makes it possible to accommodate an applicator in the volume of the hinge connection of a make-up case. It makes it possible to create a volume in the hinge connection, which is accessible in particular when the case is open.

Thanks to the invention, the applicator is perfectly protected, and there is no risk of losing it. The storage of the applicator makes it possible to improve the protection of the applicator and to avoid damaging it. It is also original, and makes it possible to save space.

In particular, the applicator can be configured to make it possible to collect and apply the product. The product can be a cosmetic, make up or care product. The product can for example be in the form of a cake of powdered product. The product need not for example be specially configured for application on the lips.

The first part of the container can for example be configured to accommodate the product to be applied. The second part of the container can for example be configured to accommodate a mirror.

The interior space can be accessible only when the device is in the open position. The interior space is not accessible when the device is in the closed position.

In the open position of the device, the first and second pans are connected to one another only by the hinge connection. On the other hand, in a closed position of the device, the first and second parts are connected to one another by the hinge connection and by a closure unit, for example a means for snapping the two parts onto one another. The first and second parts are movable relative to one another around an axis X of the hinge connection.

The interior space can have a volume with a cylindrical form. It can for example have a generally elongate form along a longitudinal axis of the axis X of the hinge connection.

The interior space can have two ends delimited by two cylindrical portions of one of the parts which cooperate with two flat portions in the form of a disc of the other one of the parts.

According to one embodiment, the interior space can have two ends delimited by two cylindrical portions of the second part which cooperate with two flat portions in the form of a disc of the first part.

As a variant, the interior space can have two ends delimited by two cylindrical portions of the first part which cooperate with two flat portions in the form of a disc of the second part.

The interior space can be delimited by at least one wall, or by two walls, extending parallel to an axis X of the hinge connection. This wall or these walls make it possible to retain the applicator in the interior space, and to prevent the applicator from being displaced outside the interior space, for example into the first part or the second part. These walls can also make it possible to retain the applicator well during a movement of rotation of the two parts relative to one another.

The applicator can be configured for application of a product on the skin, the skin of the face, the cheeks, the eyelids, the eyelashes or eyebrows, or the nails, this list being non-limiting. The applicator need not for example be configured for application of a product onto the lips.

The applicator can comprise an application unit, which for example can comprise a foam pad or bristles. The applicator can also comprise a handle on which the application unit can be secured.

The applicator can be without a reserve of product to be applied. The applicator can in particular be different from a tube of lipstick.

The applicator can comprise a grasping tab. The grasping tab can for example be situated on a handle of the applicator. It can for example be in the form of an elongate strip extending parallel to a longitudinal axis of the applicator. The grasping tab can facilitate gripping and grasping of the applicator.

The grasping tab can be rotated by at least one out of the first part or the second part during the opening or closure of the device. The rotation can take place by simple contact, in particular of the grasping tab with one or both of the first and second parts.

The hinge connection can comprise one or two pins. This pin or these pins can be concealed, in particular in cylindrical portions of the first part or the second part.

The subject of the invention is also a make-up method, independently from, or in combination with the foregoing, comprising the steps consisting of:

- loading an applicator with product using a device according to the invention, applying the product on an area to be made up consisting of human keratin materials.

The applicator used can be the applicator which is accommodated in the device, or, as a variant, another applicator.

BRIEF DESCRIPTION OF THE DRAWINGS

The invention will be able to be better understood by reading the following description of non-limiting embodiments thereof, and by examining the appended drawing, in which.

DETAILED DESCRIPTION

Figure 1:
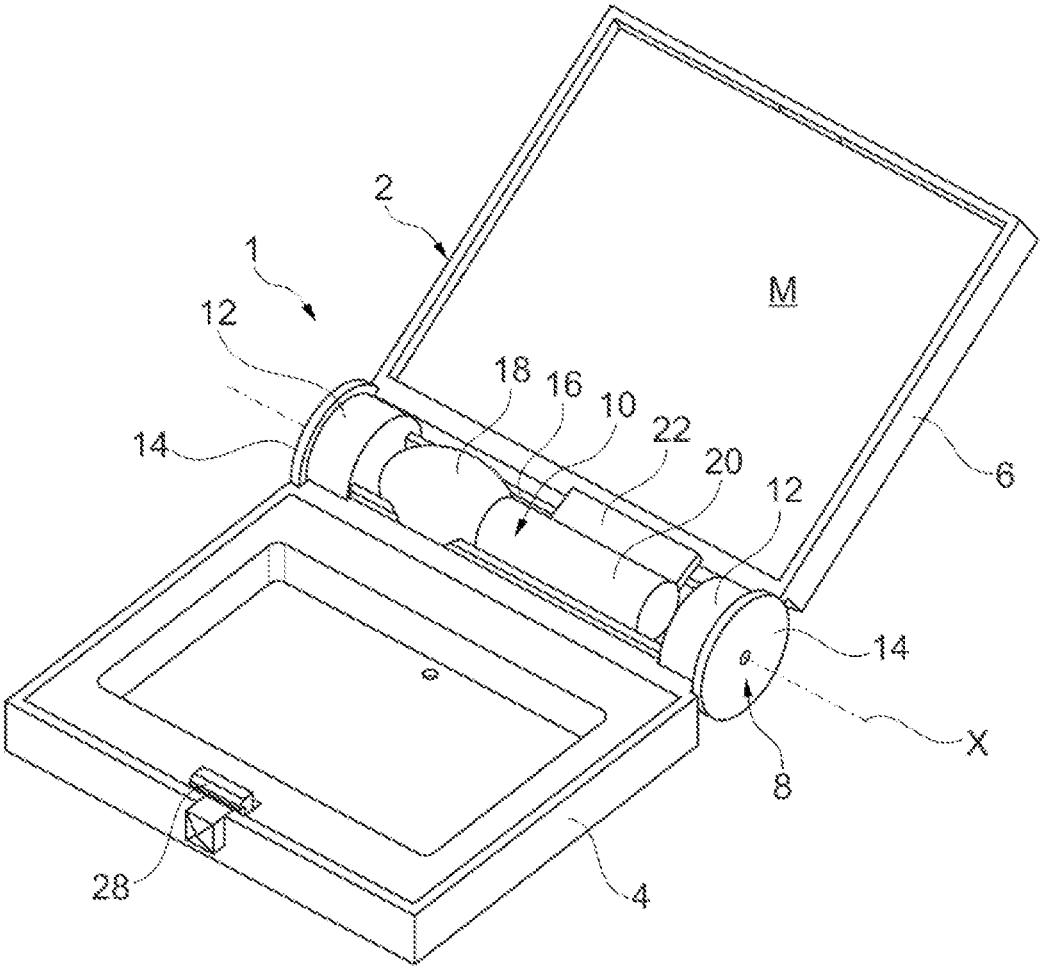
FIG. 1 is a schematic view in perspective of an example of a device according to the invention.
Figure 2:
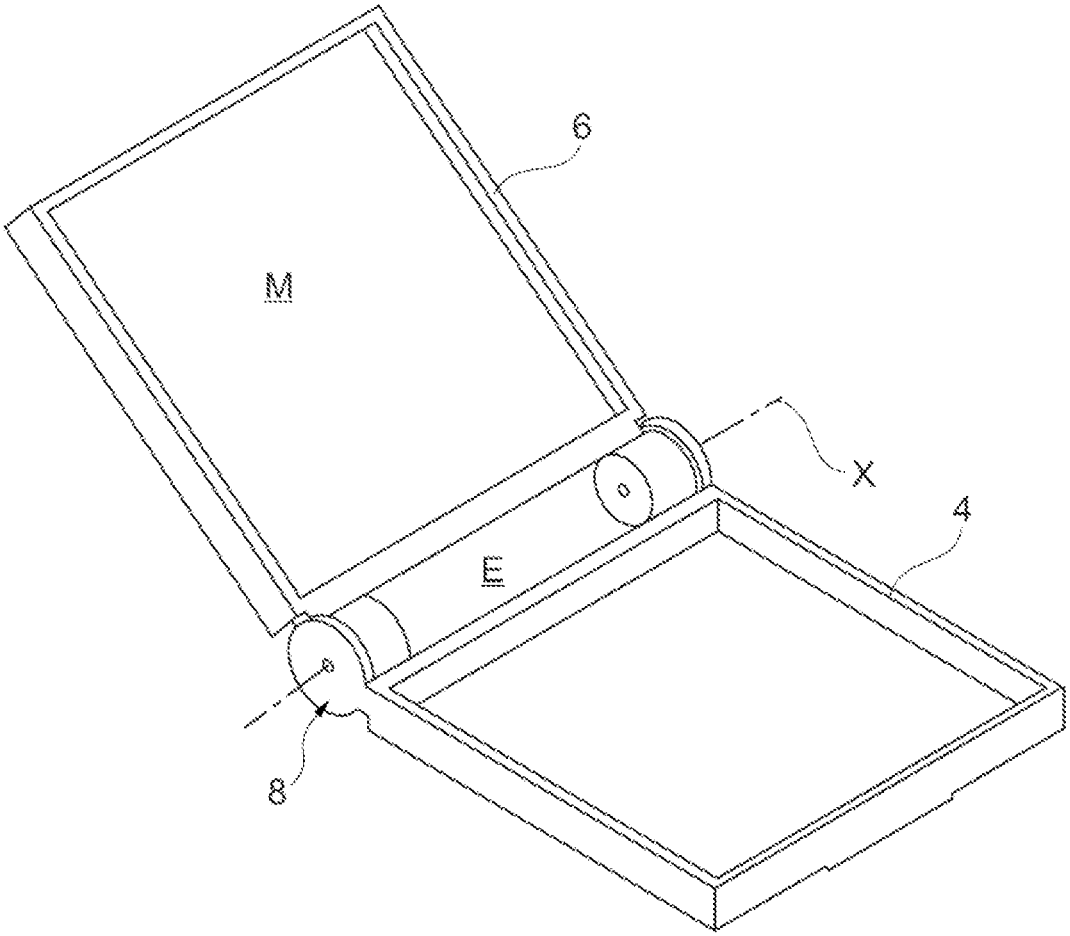
FIG. 2 is a schematic view in perspective of an example of a device according to the invention.
Figure 3:
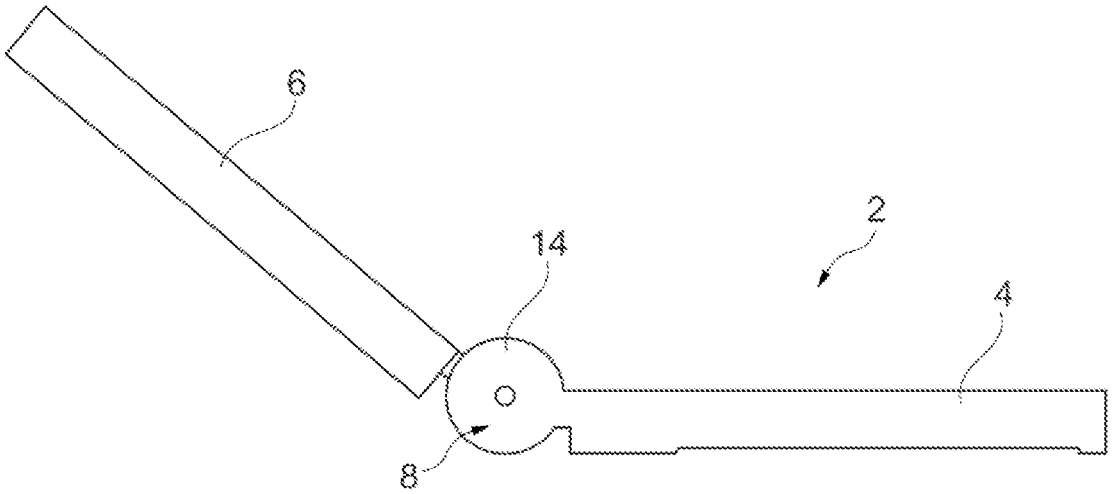
FIG. 3 is a view from the side of the device in FIG. 2.
Figure 4:
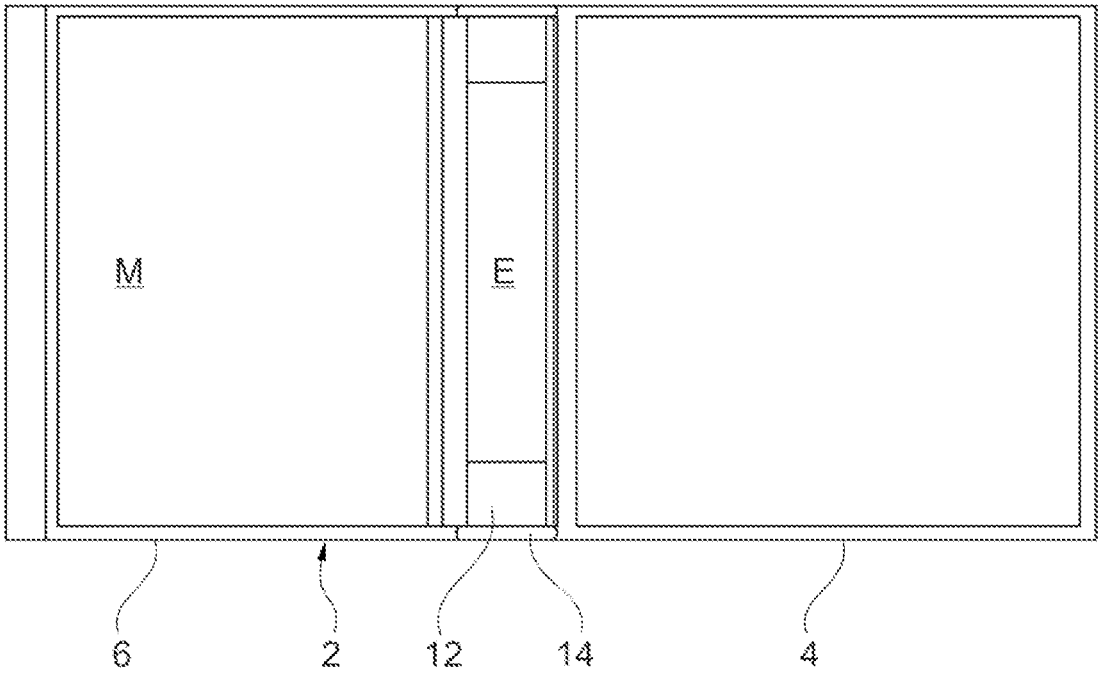
FIG. 4 is a view from above of the device in FIG. 2 in the open position.
Figure 5:
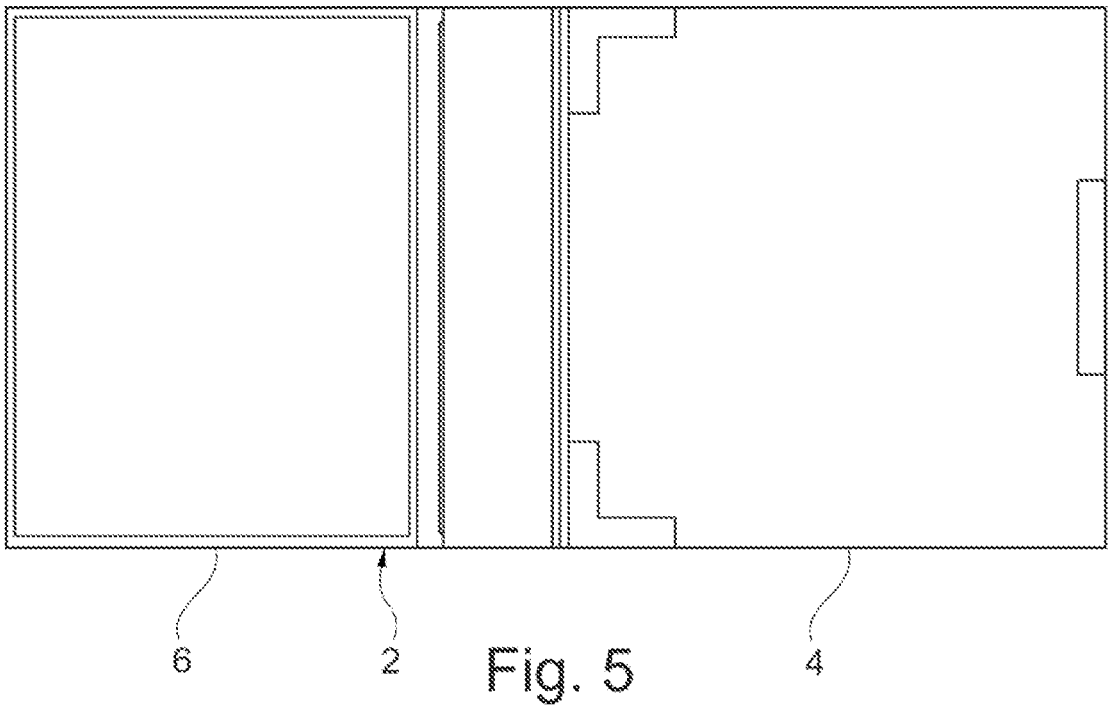
FIG. 5 is a view from below of the device in FIG. 2 in the open position.

FIG. 1 illustrates a device for packaging and application 1, comprising a container 2 containing a product to be applied. The container comprises a first part 4 and a second part 6, connected to one another by a hinge connection 8 which extends along a longitudinal axis X.

The device also comprises an applicator 10, the said applicator 10 being accommodated in an interior space E provided in the hinge connection 8.

The applicator is configured to make it possible to collect and apply the product. The applicator 10 comprises a foam pad 18. The applicator also comprises a handle 20 on which the foam pad 18 is secured.

In this example, the product is a cosmetic product which can be in the form of a cake of powdered product accommodated in the first part 4.

The second part 6 of the container makes it possible to accommodate a mirror M. It acts as a cover for closure of the first part 4. The closure can be sealed.

It is understood that the interior space E is accessible only when the device is in the open position.

The interior space E has a volume with a cylindrical form. It has a form which is generally elongate along a longitudinal axis X of the hinge connection. In the example described, it has a length of approximately 40 mm, and a radius of approximately 1 mm.

The interior space E has two ends delimited by two cylindrical portions 12 of the first part 4 which cooperate with two flat portions in the form of a disc 14 of the second part 6.

In this example, the interior space E is also delimited by two walls 16 extending parallel to an axis X of the hinge connection. These walls make it possible to retain the applicator in the interior space E.

In this embodiment, the applicator also comprises a grasping tab 22. The grasping tab is situated on the handle 20 of the applicator. It has the form of an elongate strip, extending parallel to a longitudinal axis of the applicator. In the open position illustrated in FIG. 1, it is understood that the grasping tab can be rotated by the second part, by simple contact of the grasping tab with the second part 6.

The device also comprises a closure unit 28 making it possible to snap the two parts onto one another.

In the variant embodiment illustrated in FIGS. 2 to 5, only the container 2 designed to receive a product to be applied is illustrated. The container comprises a first part 4 and a second part 6, connected to one another by a hinge connection 8 which extends along a longitudinal axis X.

The interior space is analogous to that of the embodiment in FIG. 1. It has two ends delimited by two cylindrical portions 12 of the second part 6, which portions cooperate with two flat portions in the form of a disc 14 of the first part 4.

Other variants are possible. For example, the hinge connection can comprise one or two pins. This pin or these pins can be concealed in the cylindrical portions 12.

The expression "comprising a" is to be understood as being synonymous with "comprising at least one".

The invention claimed is:

1. A packaging and application device, the device having:

a container containing a product to be applied, the container comprising a first part and a second part, which are connected to one another by a hinge connection;

an applicator, said applicator being accommodated in an interior space provided in the hinge connection, the interior space being accessible only when the device is in an open position, the interior space having two ends delimited by two cylindrical portions of one of the first or second parts which cooperate with two flat portions in a form of a disc of the other one of the first or second parts.

2. The device according to claim 1, wherein the interior space having a volume with a cylindrical form.

3. The device according to claim 1, wherein the interior space being delimited by at least one wall, or by two walls, extending parallel to an axis of the hinge connection.

4. The device according to claim 1, wherein the applicator being configured for application of a product on a skin, a skin of a face, cheeks, eyelids, eyelashes or eyebrows, or nails.

5. The device according to claim 1, wherein the applicator comprising an application unit, which comprises a foam pad or bristles.

6. The device according to claim 1, wherein the applicator being without an applicator product.

7. The device according to claim 1, wherein the applicator comprising a grasping tab.

8. The device according to claim 7, wherein the grasping tab being able to be rotated by at least one out of the first part or the second part during opening or closure of the device.

9. The device according to claim 1, wherein the hinge connection comprising one or two pins.

10. A make-up method, comprising steps of:

loading an applicator using a device according to claim 1;

applying the product on an area to be made up consisting of human keratin.

11. A packaging and application device, the device having: a container containing a product to be applied, the container comprising a first part and a second part, which are connected to one another by a hinge connection; an applicator, said applicator being accommodated in an interior space provided in the hinge connection, wherein the interior space has a volume with a cylindrical form having two closed ends, wherein each closed end cooperate with a flat portion having a disc form; the interior space being accessible only when the device is in an open position, through a circumferential portion of the cylindrical form.

* * * * *